US010215035B2

(12) United States Patent
Dierksmeier et al.

(10) Patent No.: US 10,215,035 B2
(45) Date of Patent: Feb. 26, 2019

(54) TURBINE WHEELS WITH PRELOADED BLADE ATTACHMENT

(71) Applicant: Rolls-Royce North American Technologies, Inc., Indianapolis, IN (US)

(72) Inventors: Douglas D. Dierksmeier, Franklin, IN (US); Tab M. Heffernan, Plainfield, IN (US)

(73) Assignee: Rolls-Royce North American Technologies Inc., Indianapolis, IN (US)

( * ) Notice: Subject to any disclaimer, the term of this patent is extended or adjusted under 35 U.S.C. 154(b) by 543 days.

(21) Appl. No.: 14/974,475

(22) Filed: Dec. 18, 2015

(65) Prior Publication Data

US 2016/0186581 A1 Jun. 30, 2016

Related U.S. Application Data

(60) Provisional application No. 62/097,347, filed on Dec. 29, 2014.

(51) Int. Cl.
*F01D 5/30* (2006.01)
*F01D 5/32* (2006.01)

(52) U.S. Cl.
CPC ..... *F01D 5/3007* (2013.01); *F01D 5/323* (2013.01); *F05D 2240/24* (2013.01); *F05D 2240/30* (2013.01)

(58) Field of Classification Search
CPC .... F01D 5/3007; F01D 5/323; F05D 2240/30; F05D 2240/24
See application file for complete search history.

(56) References Cited

U.S. PATENT DOCUMENTS 2,786,648 A * 3/1957 Ledwith ..... F01D 5/323 416/221
2,928,651 A * 3/1960 Turnbull ..... F01D 5/323 416/221
2,942,842 A * 6/1960 Hayes ..... F01D 5/30 416/220 R
3,045,329 A * 7/1962 Carli ..... F01D 5/323 29/513
3,216,699 A * 11/1965 Schoenborn ..... F01D 5/22 416/190
3,248,081 A * 4/1966 Bobo ..... F01D 5/323 416/191
4,478,554 A * 10/1984 Surdi ..... F01D 5/323 416/220 R
5,123,813 A 6/1992 Przytulski et al.
5,622,476 A * 4/1997 Adde ..... F01D 5/323 416/220 R (Continued)

*Primary Examiner* — Eldon T Brockman

(74) *Attorney, Agent, or Firm* — Barnes & Thornburg LLP

(57) ABSTRACT

A wheel assembly for a gas turbine engine is disclosed. The wheel assembly includes a disk arranged for rotation about a central axis and formed to include a plurality of slots. The wheel assembly also includes a plurality of blades sized to be received in the plurality of slots so that the blades are coupled to the disk for common rotation about the central axis. The wheel assembly further includes a plurality of blade biasers positioned in the slots between the disk and the blades so that the blade biasers are engaged with the disk and the blades to preload the blades away from the central axis.

17 Claims, 4 Drawing Sheets

(56) References Cited

U.S. PATENT DOCUMENTS

| | | | | |
|---|---|---|---|---|
| 6,447,253 | B2 | 9/2002 | Tempere | |
| 6,905,311 | B2 * | 6/2005 | Leathart | F01D 5/323 416/221 |
| 8,182,230 | B2 | 5/2012 | Stone | |
| 8,186,961 | B2 | 5/2012 | Stone | |
| 8,439,635 | B2 * | 5/2013 | Uskert | F01D 5/323 415/189 |
| 8,485,785 | B2 | 7/2013 | Garner et al. | |
| 8,512,001 | B2 | 8/2013 | Benkler et al. | |
| 8,616,850 | B2 | 12/2013 | Ward et al. | |
| 9,518,470 | B2 * | 12/2016 | Illand | F01D 5/3007 |
| 2004/0013528 | A1 * | 1/2004 | Leathart | F01D 5/323 416/220 R |
| 2009/0060746 | A1 * | 3/2009 | Barr, Jr. | F01D 5/323 416/221 |
| 2010/0183444 | A1 * | 7/2010 | Stone | F01D 5/3053 416/220 R |
| 2013/0302171 | A1 * | 11/2013 | Illand | F01D 5/3007 416/220 |
| 2014/0178202 | A1 | 6/2014 | Chatenet et al. | |

* cited by examiner

TURBINE WHEELS WITH PRELOADED BLADE ATTACHMENT

CROSS REFERENCE TO RELATED APPLICATIONS

This application claims priority to and the benefit of U.S. Provisional Patent Application No. 62/097,347, filed 29 Dec. 2014, the disclosure of which is now expressly incorporated herein by reference.

FIELD OF THE DISCLOSURE

The present disclosure relates generally to gas turbine engines, and more specifically to turbine wheel assemblies used in gas turbine engines.

BACKGROUND

Gas turbine engines are used to power aircraft, watercraft, power generators, and the like. Gas turbine engines typically include a compressor, a combustor, and a turbine. The compressor compresses air drawn into the engine and delivers high pressure air to the combustor. In the combustor, fuel is mixed with the high pressure air and is ignited. Products of the combustion reaction in the combustor are directed into the turbine where work is extracted to drive the compressor and, sometimes, an output shaft. Left-over products of the combustion are exhausted out of the turbine.

Compressors and turbines typically include alternating stages of static vane assemblies and rotating wheel assemblies. The rotating wheel assemblies include disks carrying blades around their outer edges. To assemble each of the rotating wheel assemblies, roots of the blades are received by slots formed in each disk so that each disk and the blades carried by the disk are coupled together for common rotation. In operation of the rotating wheel assemblies, stresses applied to each disk and the blades received by each disk complicate the attachment of the blades to the disks. Designs of the roots of the blades and the corresponding wheel slots that decrease the stresses applied to the blades and the wheels during operation of the rotating wheel assemblies remain an area of interest.

SUMMARY

The present disclosure may comprise one or more of the following features and combinations thereof.

A wheel assembly for a gas turbine engine may include a disk, a plurality of blades, and a plurality of blade biasers. The disk may be arranged for rotation about a central axis, and the disk may be formed to include a plurality of slots circumferentially arranged adjacent one another. The plurality of blades may include roots sized to be received in the plurality of slots so that the plurality of blades are coupled to the disk for common rotation about the central axis. The plurality of blade biasers may be positioned in the plurality of slots between the disk and the roots of each of the plurality of blades. The blade biasers may be engaged with the disk and the roots of the plurality of blades to preload the plurality of blades away from the central axis when the assembly is at rest and reduce the range of centrifugal loads experienced by the disk and the plurality of blades during rotation of the wheel assembly within the gas turbine engine.

In some embodiments, the blade biasers may each include a wedge and a biasing element coupled to the wedge. Each of the wedges may have (i) a first portion adjacent the biasing element having a first thickness and (ii) a second portion opposite the first portion having a second thickness. Each of the wedges may be tapered so that the first thickness is less than the second thickness. Additionally, in some embodiments, the biasing elements may be arranged to urge the wedges to move parallel to the central axis through the slots to cause the wedges to engage the disk and the roots of each of the plurality of blades to preload the plurality of blades away from the central axis. In some embodiments still, each of the biasing elements may include a generally U-shaped spring member, and the generally U-shaped spring members of the biasing elements may be positioned outside of the slots. In other embodiments, the assembly may include a coating applied between each of the wedges and the disk to resist degradation of the wedges and the disk resulting from relative movement between the wedges and the disk parallel to the central axis during operation of the gas turbine engine. Additionally, in other embodiments, each blade biaser may be a monolithic component. In other embodiments still, the wedge of at least one of the blade biasers may include a pin having an elliptical cross-sectional shape. The biasing element of the at least one of the blade biasers may include an arm coupled to the pin.

According to another aspect of the present disclosure, a wheel assembly for a gas turbine engine may include a disk, a plurality of blades, and a plurality of blade biasers. The disk may be arranged for rotation about a central axis, and the disk may be formed to include a plurality of slots circumferentially arranged adjacent one another. The plurality of blades may include roots sized to be received in the plurality of slots so that the plurality of blades are coupled to the disk for common rotation about the central axis. The plurality of blade biasers may be positioned in each of the plurality of slots between the disk and the roots of each of the plurality of blades. The blade biasers may each include a wedge and a biasing element coupled to the wedge.

In some embodiments, each of the wedges may include a first portion and a second portion arranged closer to the biasing element than the first portion, and the first portion may have a greater thickness than the second portion. The biasing elements may be arranged to urge the wedges to move parallel to the central axis through the slots to cause the first portions of the wedges to engage the disk and the roots of each of the plurality of blades.

In some embodiments, each of the biasing elements may include a generally U-shaped spring member, and the generally U-shaped spring members of the biasing elements may be positioned outside of the slots. Additionally, in some embodiments, the assembly may further include a coating applied between each of the wedges and the disk to resist degradation of the wedges and the disk resulting from relative movement between the wedges and the disk parallel to the central axis during operation of the gas turbine engine.

In some embodiments, each of the wedges may include a pin having an elliptical cross-sectional shape. Each of the biasing elements may include an arm coupled to the pin. Substantially all of the arms of the blade biasers may be positioned outside of the slots during operation of the gas turbine engine.

According to another aspect of the present disclosure, a method of preloading a blade of a wheel assembly for a gas turbine engine may include arranging a blade biaser in one of a plurality of slots formed in a disk of the wheel assembly between the disk and a root of the blade sized to be received in the one of the plurality of slots so that the blade biaser engages the disk and the root of the blade in a first position prior to operation of the wheel assembly, and operating the wheel assembly to cause the blade to experience a centrifugal load during operation of the wheel assembly that allows the blade biaser to move in the one of the plurality of slots to engage the disk and the root of the blade in a second position different from the first position to preload the blade away from a center of the disk.

In some embodiments, (i) arranging the blade biaser in the one of the plurality of slots may include arranging a first portion of the blade biaser having a first thickness in the one of the plurality of slots so that the first portion engages the disk and the root of the blade in the first position, and (ii) operating the wheel assembly may include engaging a second portion of the blade biaser having a second thickness greater than the first thickness with the disk and the root of the blade in the second position. Additionally, in some embodiments, operating the wheel assembly may include rotating an oval-shaped portion of the blade biaser in the one of the plurality of slots between the first position and the second position.

These and other features of the present disclosure will become more apparent from the following description of the illustrative embodiments.

DETAILED DESCRIPTION OF THE DRAWINGS

Figure 1:
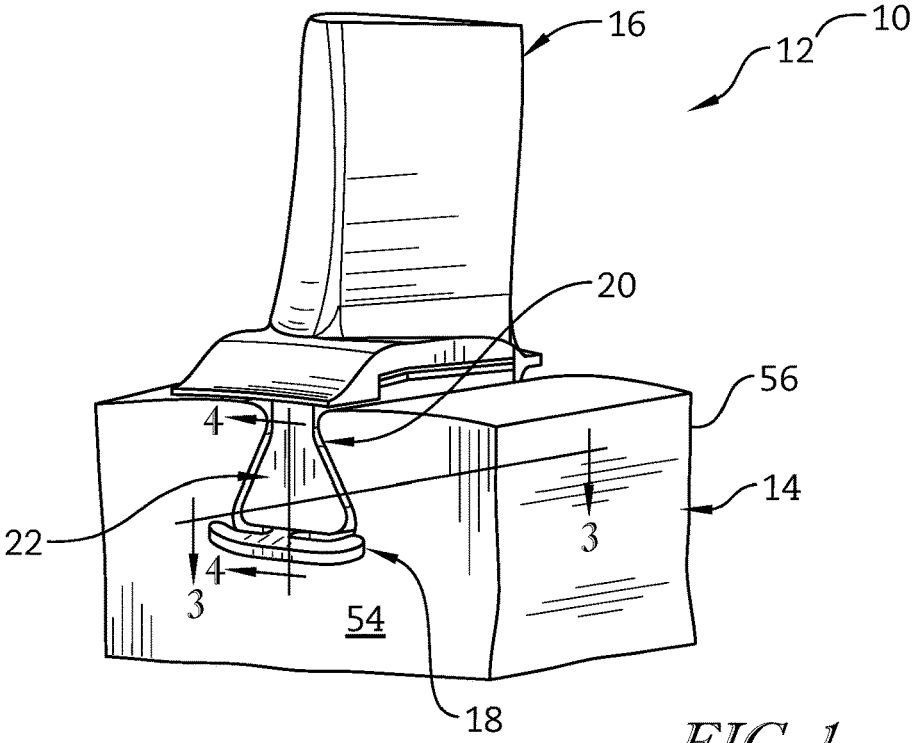
FIG. 1 is a perspective view of a portion of a wheel assembly of a gas turbine engine showing a disk, a blade coupled to the disk, and a blade biaser arranged between the disk and the blade.

For the purposes of promoting an understanding of the principles of the disclosure, reference will now be made to a number of illustrative embodiments illustrated in the drawings and specific language will be used to describe the same.

Referring now to FIG. 1, a portion of an illustrative wheel assembly 12 adapted for use in a gas turbine engine is shown. The illustrative wheel assembly 12 is adapted for use in a turbine of a gas turbine engine. In other embodiments, the wheel assembly 12 may be adapted for use in a compressor or a fan of a gas turbine engine.

The wheel assembly 12 illustratively includes a disk 14, a plurality of blades 16 (one of which is shown in FIG. 1), and a plurality of blade biasers 18 (one of which is shown in FIG. 1). The disk 14 is configured for rotation about a central axis 11 of the engine. The plurality of blades 16 are coupled to the disk 14 for common rotation therewith about the central axis 11. The plurality of blade biasers 18 are positioned radially between the disk 14 and the plurality of blades 16 as shown in FIG. 1. As discussed in greater detail below, the blade biasers 18 are engaged with the disk 14 and the blades 16 to preload the blades away from the central axis 11 (and thus a center of the disk 14) when the wheel assembly 12 is at rest. As a result, the range of centrifugal loads and stresses experienced at the attachment interface formed by the disk 14 and the preloaded blades 16 during rotation of the wheel assembly 12 within an engine is reduced.

The reduced range of centrifugal loads and stresses experienced at the attachment interface formed by the disk 14 and the preloaded blades 16 during rotation of the wheel assembly 12 may provide a number of benefits. For instance, the reduced stress range results in increased low cycle fatigue life at the attachment interface. Also, the preloaded blades 16 may reduce the motion of surfaces of the disk 14 and the blades 16 at the attachment interface relative to one another, thereby decreasing fretting and allowing for those surfaces to experience greater stresses during rotation of the wheel assembly 12.

Figure 2:
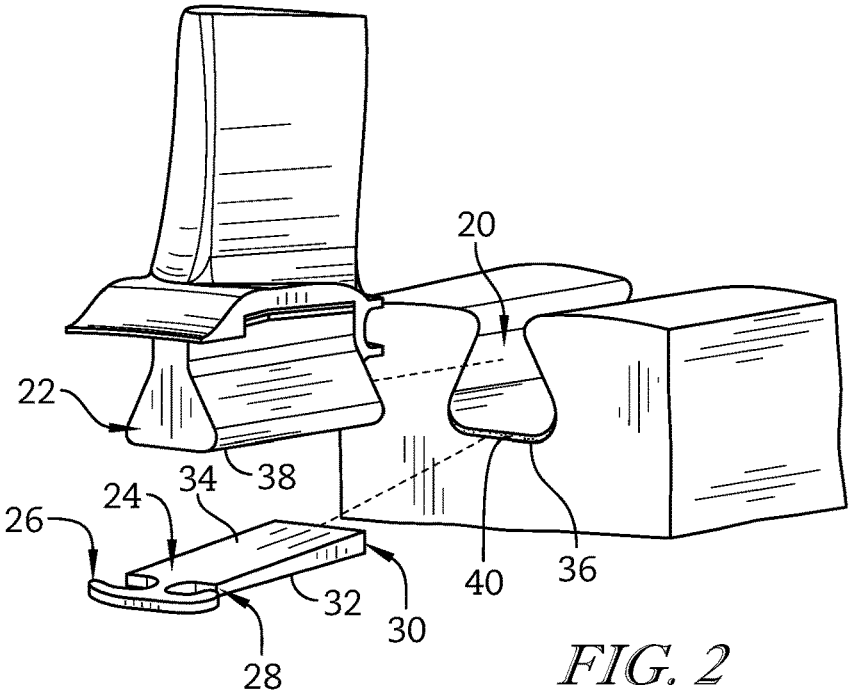
FIG. 2 is an exploded assembly view of the portion of the wheel assembly of FIG. 1.

The disk 14 is illustratively formed to include a plurality of slots 20, one of which is best seen in FIG. 2, circumferentially arranged adjacent one another. The plurality of blades 16 includes roots 22 sized to be received in the plurality of slots 20 to couple the blades 16 to the disk 14 for common rotation therewith about the central axis 11 as indicated above. The blade biasers 18 are positioned in the slots 20 between the disk 14 and the roots 22 of the blades 16 as shown in FIGS. 1-2. The blade biasers 18 engage the disk 14 and the blades 16 during assembly and subsequent operation of the illustrative wheel assembly 12.

Referring now to FIG. 2, the blade biasers 18 illustratively include wedges 24 and biasing elements 26 coupled to the wedges 24. The wedges 24 are illustratively positioned in the slots 20 so that the wedges 24 engage the disk 14 and the blades 16. Portions of the biasing elements 26 are positioned outside of the slots 20.

Figure 4:
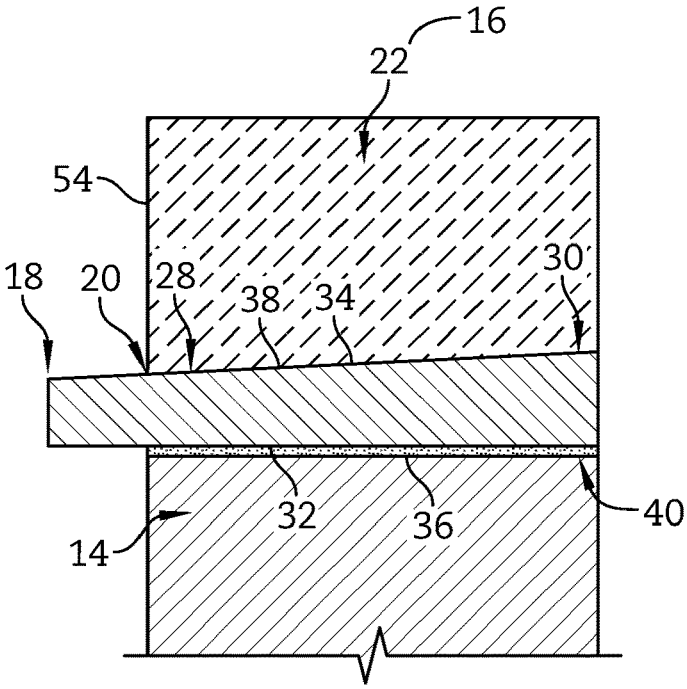
FIG. 4 is a sectional view of the portion of the wheel assembly of FIG. 1 taken at line 4-4.

Each wedge 24 of the blade biasers 18 is generally rectangular when viewed from a radially outward point of view as shown in FIGS. 2 and 4. Each wedge 24 includes a first portion 28 adjacent the biasing element 26 that has a first thickness. Each wedge 24 also includes a second portion 30 spaced apart from the biasing element 26 and opposite the first portion 28 that has a second thickness. Each wedge 24 is illustratively tapered as best seen in FIG. 4 so that the first thickness of the portion 28 adjacent the biasing element 26 is less than the second thickness of the portion 30.

Each wedge 24 also includes a surface 32 facing radially inward to engage a surface 36 of the disk 14 and a surface 34 opposite the surface 32 as shown in FIG. 2. The surface 34 faces radially outward to engage at least a portion of a radially inner surface 38 of the root 22 of each blade 16. The surface 34 contacts the inner surface 38 at both the first portion 28 and the second portion 30 to preload the blades 16 of the assembly 12, as best seen in FIG. 4 and discussed in more detail below.

The illustrative wheel assembly 12 further includes a coating 40 that is applied between the surface 32 of each wedge 24 and each surface 36 of the disk 14 as shown in FIG. 2. The coating 40 may be an environment barrier coating adapted to resist degradation of the wedges 24 and the disk 14 resulting from relative movement between the wedges 24 and the disk 14 parallel to the central axis 11 during operation of the wheel assembly 12. As such, the coating 40 may reduce galling or other damage caused by contact between the surfaces 32, 36 during operation of the wheel assembly 12.

Figure 3:
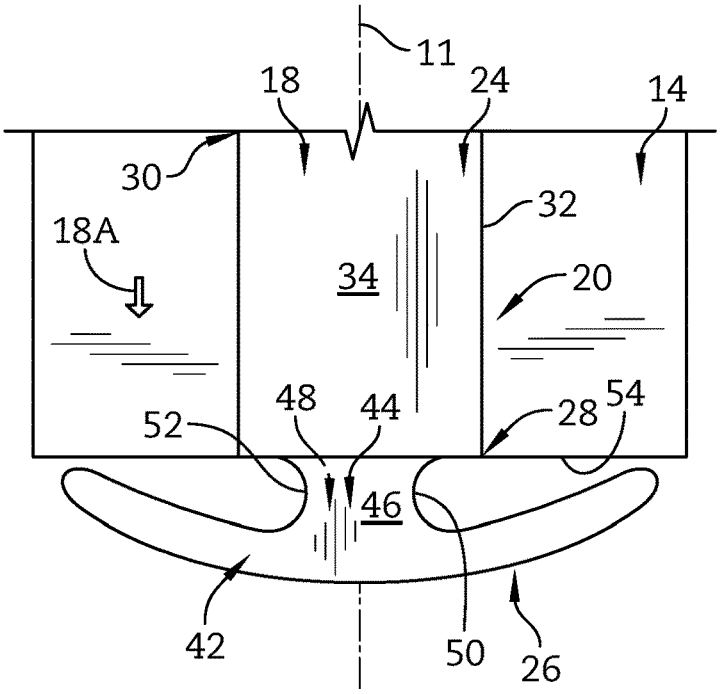
FIG. 3 is a sectional view of a portion of the wheel assembly of FIG. 1 taken at line 3-3.

Referring now to FIG. 3, each biasing element 26 of the blade biasers 18 illustratively includes a U-shaped spring member 42 and a neck 44 interconnected with the U-shaped spring member 42. The neck 44 is interconnected with the portion 28 of each wedge 24 and extends outwardly therefrom toward the U-shaped spring member 42. Each blade biaser 18 is illustratively a monolithic component as best seen in FIGS. 2-3.

The neck 44 of each biasing element 26 includes a top surface 46, a bottom surface 48 opposite the top surface 46, and a pair of curved side surfaces 50, 52 opposite one another as shown in FIG. 3. The side surfaces 50, 52 are concave as shown in FIG. 3. The neck 44 of the blade biaser 18 shown in FIG. 3 is illustratively positioned outside of the slot 20. However, a portion of the neck 44 may be positioned in the slot 20 when assembling the wheel assembly 12.

The U-shaped spring member 42 of each biasing element 26 is illustratively positioned outside of each slot 20 during assembly and subsequent operation of the wheel assembly 12 as shown in FIG. 3. Each blade biaser 18 is positioned in each slot 20 so that the U-shaped member 42 extends outwardly from a forward surface 54 of the disk 14 as shown in FIG. 3. In other embodiments, each blade biaser 18 may be positioned in each slot 20 so that the U-shaped member 42 extends outwardly from an aft surface 56 of the disk 14 opposite the forward surface 54.

During initial operation of the assembly 12, the neck 44 and the spring member 42 cooperatively urge the wedge 24 of each blade biaser 18 to move parallel to the central axis 11 in each slot 20 from a first position to a second position as suggested by arrow 18A in FIG. 4. Each blade biaser 18 is placed in the first position when assembling the wheel assembly 12. In the first position, each blade biaser 18 is loosely placed in each slot 20 so that the first portion 28 of each wedge 24 engages the disk 14 and each blade 16. During initial operation of the assembly 12, the blades 16 and the disk 14 experience centrifugal loads that induce the roots 22 to move away from the central axis 11, thereby creating space between the surfaces 38, 36 of the blades 16 and the disk 14, respectively. The biasing element 26 of each blade biaser 18 urges each wedge 24 to move to the second position so that each blade biaser 18 is received in the space between the surfaces 38, 36. As such, the second portion 30 of each wedge 24 engages the disk 14 and the root 22 of each blade 16 in the second position. When the blade biasers 18 are in the second position, the blades 16 are therefore preloaded away from the central axis 11 during initial operation of the assembly 12.

Referring now to FIG. 4, the blade biasers 18 are shown in the second position in which the blades 16 are preloaded away from the central axis 11. Specifically, the second portion 30 of each blade biaser 18 slides to the left (i.e., in the forward direction) and contacts the inner surface 38 while the surface 34 contacts the inner surface 38 at the first portion 28 during initial operation of the wheel assembly 12 as shown in FIG. 4.

The loads experienced by the preloaded blades 16 and the disk 14 at rest (i.e., following initial operation of the assembly 12) are closer in magnitude to the loads experienced by the preloaded blades 16 and the disk 14 in subsequent operations of the assembly 12 than would otherwise be the case (i.e., with no preloading). As such, the preloaded blades 16 reduce the range of loads experienced by the blades 16 and the disk 14 during subsequent operations of the assembly 12.

Figure 5:
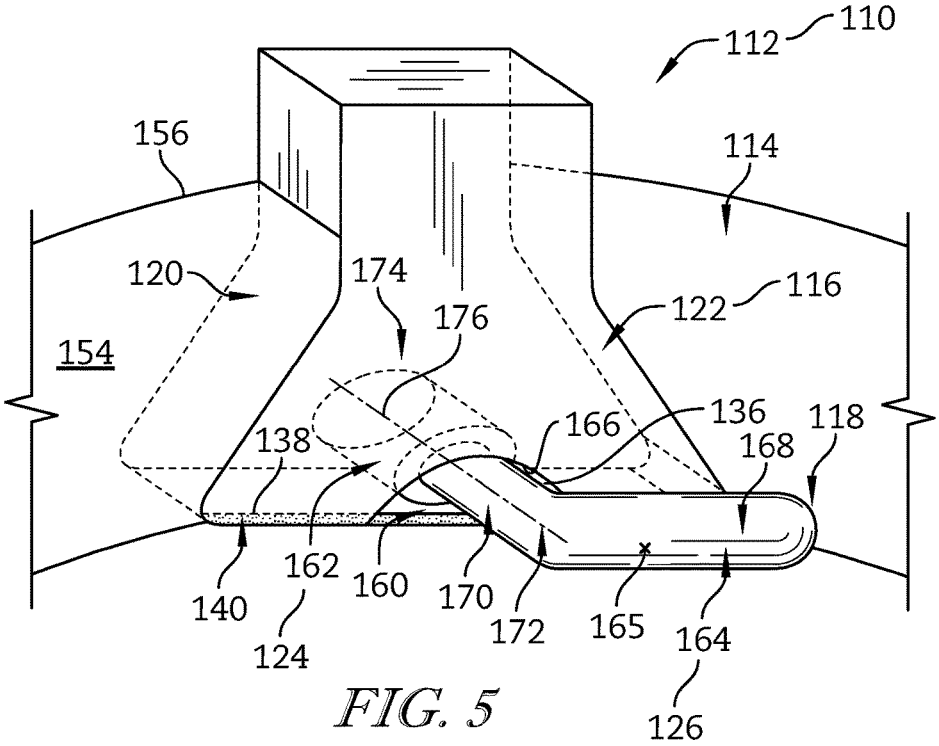
FIG. 5 is a perspective view of a portion of another wheel assembly of a gas turbine engine showing a disk, a blade coupled to the disk, and a blade biaser arranged between the disk in a first position.

Referring now to FIG. 5, another wheel assembly 112 for use in a gas turbine engine is shown. The wheel assembly 112 is substantially similar to the wheel assembly 12 shown in FIGS. 1-4 and described herein. In the illustrative wheel assembly 112, each of the blades 116 is formed to include a notch 160 extending parallel to the central axis therethrough. Unlike the blade biasers 18 of the assembly 12, each wedge 124 of each blade biaser 118 is illustratively embodied as a pin 162 positioned in the notch 160, and each biasing element 126 of each blade biaser 118 is illustratively embodied as an arm 164 coupled to the pin 162. Like each blade biaser 18 of the assembly 12, each blade biaser 118 of the assembly 112 is illustratively a monolithic component.

The pin 162 of the illustrative blade biaser 118 shown in FIG. 5 is positioned in the slot 120 between the disk 114 and the root 122 of the blade 116 during assembly and operation of the wheel assembly 112. The pin 162 engages a concave surface 166 of the root 122 and the surface 136 of the disk 114. The pin 162 illustratively is oval-shaped and has an elliptical cross-sectional shape.

Figure 6:
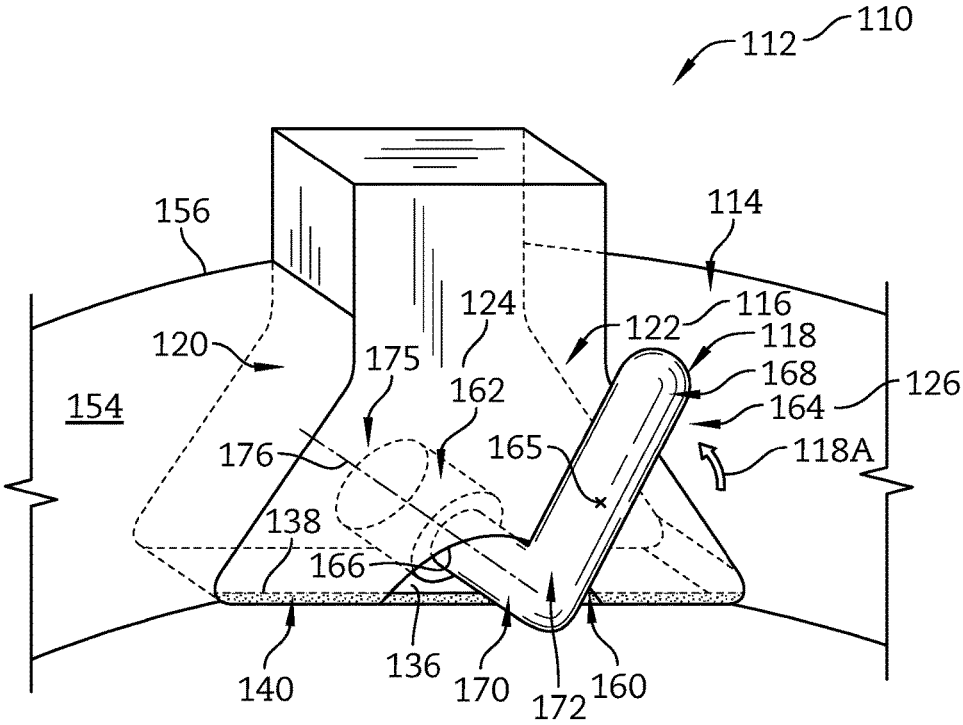
FIG. 6 is another perspective view of the portion of the wheel assembly of FIG. 5 showing the blade biaser arranged between the disk in a second position.

Substantially all of the arm 164 of the illustrative blade biaser 118 shown in FIG. 5 is positioned outside of the slot 120 during assembly and operation of the wheel assembly 112. The arm 164 illustratively extends outwardly from the forward surface 154 of the disk 114 as shown in FIGS. 5-6. In other embodiments, the blade biaser 118 may be positioned in the slot 120 such that the arm 164 extends outwardly from the aft surface 156 of the disk 114. In other embodiments still, the blade biaser 118 may include two arms 164 coupled to opposite ends of the pin 162, and the blade biaser 118 may be positioned in the slot 120 such that one of the arms 164 extends outwardly from each of the forward and aft surfaces 154, 156 of the disk 114.

The arm 164 includes a first portion 168 interconnected with a second portion 170 of the arm 164. The second portion 170 extends at an angle to the first portion 168 as shown in FIG. 5. As such, the arm 164 also includes an elbow 172 positioned between the first portion 168 and the second portion 170. The arm 164 is generally cylindrical as shown in FIGS. 5-6, and the arm 164 has a center of gravity offset from that of the pin 162.

During initial operation of the assembly 112, each blade biaser 118 rotates under centrifugal loads in each slot 120 from a first position 174 shown in FIG. 5 to a second position 175 shown in FIG. 6. Each blade biaser 118 is placed in the first position 174 when assembling the wheel assembly 112. In the first position 174, each blade biaser 118 is placed in each slot 120 so that the pin 162 of each blade biaser 118 engages the disk 114 and each blade 116. The first portion 168, the elbow 172, and the second portion 170 of each arm 164 are arranged at approximately equal distances in the radial direction from the central axis as shown in FIG. 5.

During initial operation of the assembly 112, the blades 116 and the disk 114 experience centrifugal loads that induce the roots 122 to move away from the central axis, thereby creating space between the surfaces 138, 136 of the blades 116 and the disk 114, respectively. Because the center of gravity of the arm 164 is offset from that of the pin 162, the centrifugal loads experienced by the blades 116 and the disk 114 cause each blade biaser 118 to rotate (e.g., in the counterclockwise direction indicated by arrow 118A) about a pin axis 176 defined by the pin 162 to the second position 175. In the second position 175, each pin 162 is received in the space between the surfaces 138, 136 so that the blades 116 are preloaded away from the central axis during initial operation of the assembly 112.

Referring now to FIG. 6, the blade biasers 118 are shown in the second position 175 in which the blades 116 are preloaded away from the central axis. In the second position 175, the first portions 168 of the arms 164 are arranged at greater distances in the radial direction from the central axis than the elbows 172 and the second portions 170 of the arms 164.

The loads experienced by the preloaded blades 116 and the disk 114 at rest (i.e., following initial operation of the assembly 112) are closer in magnitude to the loads experienced by the preloaded blades 116 and the disk 114 in subsequent operations of the assembly 112 than would otherwise be the case (i.e., with no preloading). As such, the preloaded blades 116 reduce the range of loads experienced by the blades 116 and the disk 114 during subsequent operations of the assembly 112.

In other embodiments, a hole offset from the axis 176 may be formed in the pin 162 of each blade biaser 118. As a result, when the blades 116 and the disk 114 experience centrifugal loads during initial operation of the assembly 112, each blade biaser 118 rotates to the second position 175 to preload the blades 116 as discussed above.

Figure 7:
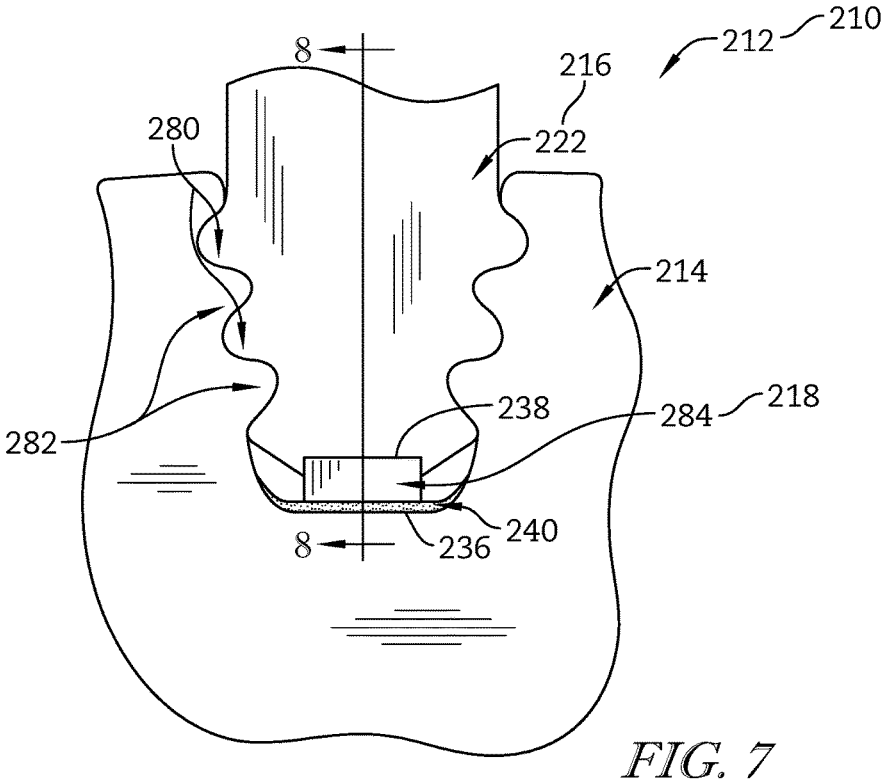
FIG. 7 is a front elevation view of a portion of yet another wheel assembly of a gas turbine engine showing a disk, a blade coupled to the disk, and a blade biaser arranged between the disk and the blade.
Figure 8:
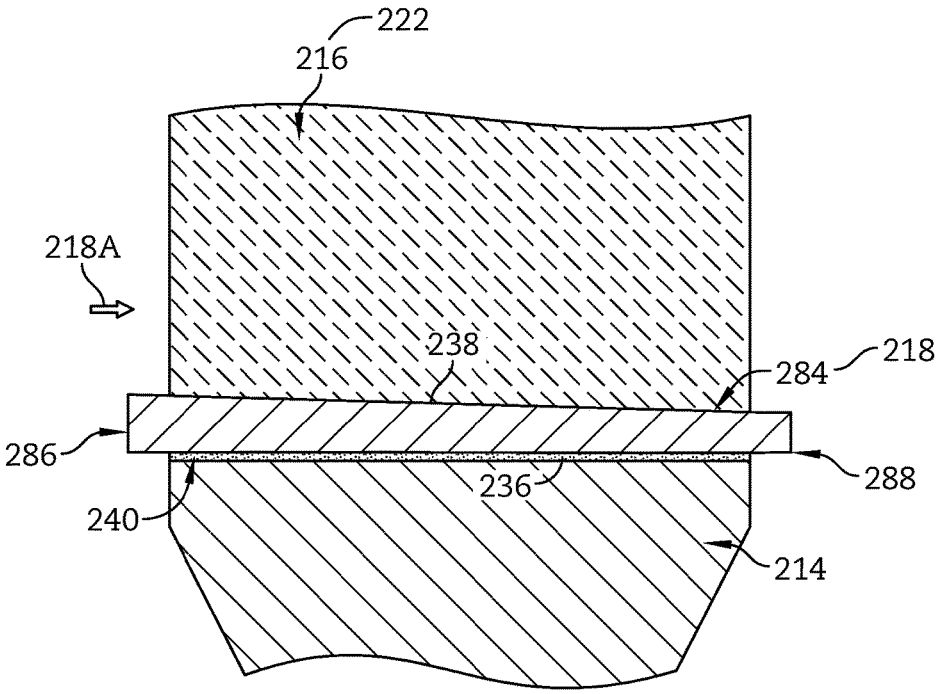
FIG. 8 is a sectional view of the portion of the wheel assembly of FIG. 7 taken at line 8-8.

Referring now to FIG. 7, yet another wheel assembly 212 for use in a gas turbine engine is shown. The wheel assembly 212 is substantially similar to the wheel assembly 12 shown in FIGS. 1-4 and described herein. In the illustrative wheel assembly 212, the root 222 of each blade 216 is formed to include a plurality of barbs 280, and the plurality of barbs 280 are received in cutouts 282 formed in the disk 214 when each blade 216 is received in each slot 220. The illustrative combination of barbs 280 and cutouts 282 is sometimes called a fir tree-type attachment. Blade biasers 218 are positioned between the surface 238 of each root 222 and the surface 236 of the disk 214 so that the blade biasers 218 engage each blade 216 and the disk 214 during assembly and operation of the assembly 212. Like each blade biaser 18 of the assembly 12, each blade biaser 218 of the assembly 212 is illustratively a monolithic component Unlike each blade biaser 18, each blade biaser 218 is illustratively embodied as a generally rectangular wedge 224. As best seen in FIG. 8, each wedge 224 is tapered so that a first portion 286 has a first thickness and a second portion 288 has a second thickness less than the first thickness. During operation and assembly of the assembly 212, substantially all of each wedge 224 is positioned in each slot 220.

During initial assembly of wheel 212, each blade biaser 218 is pushed in each slot 220 parallel to the central axis from a first position to a second position as suggested by arrow 218A in FIG. 8. In the illustrative embodiment, a rubber mallet may be used to tap the blade biasers 218 into place so that the blades 216 are therefore preloaded away from the central axis during initial operation of the assembly 212.

The loads experienced by the preloaded blades 216 and the disk 214 at rest are closer in magnitude to the loads experienced by the preloaded blades 216 and the disk 214 in subsequent operations of the assembly 212 than would otherwise be the case (i.e., with no preloading). As such, the preloaded blades 216 reduce the range of loads and stresses experienced by the blades 216 and the disk 214 during subsequent operations of the assembly 212.

Referring to FIGS. 1-8, a method of preloading one of the blades 16, 116 may include arranging one of the blade biasers 18, 118 in one of the slots 20, 120 between the disk 14, 114 and the root 22, 122 of the blade 16, 116 so that the blade biaser 18, 118 engages the disk 14, 114 and the root 22, 122 in a first position prior to operation of the wheel assembly 12, 112. The method may also include operating the wheel assembly 12, 112 to cause the blade 16, 116 to experience a centrifugal load during operation of the wheel assembly 12, 112. In some embodiments, movement of the blades 16, 116 may allow the blade biaser 18, 118 to move in the slot 20, 120 to engage the disk 14, 114 and the root 22, 122 of the blade 16, 116 in a second position different from the first position to preload the blade 16, 216 away from a center of the disk 14, 114.

Arranging the blade biaser 18 in the slot 20 may include arranging the first portion 28 of the blade biaser 18 in the slot 20 so that the first portion 28 engages the disk 14 and the root 22 of the blade 16 in the first position. Operating the wheel assembly 12 may include engaging the second portion 30 of the blade biaser 18 with the disk 14 and the root 22 of the blade 16 in the second position. Alternately, operating the wheel assembly 112 may include rotating the pin 162 of the blade biaser 118 in the slot 120 between the first position 174 and the second position 175.

In another embodiment, a method of preloading one of the blades 216 of the wheel assembly 212 may include arranging a blade biaser 218 in a slot 220 between the disk 214 and the root 222 of the blade 216 so that the one of the blades 216 is in the first position. The method may also include pushing the blade biaser 218 during assembly to cause the blade biaser 218 to move to the second position so that the one blade 216 is preloaded away from a center of the disk 214.

While the disclosure has been illustrated and described with reference to an aerospace gas turbine engine, the teachings are also applicable for use in other types of turbine applications. For example, energy turbines, marine turbines, pumping turbines, and other types of turbines may incorporate the teachings of this disclosure without departure from the scope of the present description.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A wheel assembly for a gas turbine engine, the assembly comprising a disk arranged for rotation about a central axis, the disk formed to include a plurality of slots circumferentially arranged adjacent one another, a plurality of blades, the plurality of blades including roots sized to be received in the plurality of slots so that the plurality of blades are coupled to the disk for common rotation about the central axis, and a plurality of blade biasers positioned in the plurality of slots between the disk and the roots of each of the plurality of blades, the blade biasers being engaged with the disk and the roots of the plurality of blades to preload the plurality of blades away from the central axis when the wheel assembly is at rest and reduce the range of centrifugal loads experienced by the disk and the plurality of blades during rotation of the wheel assembly within the gas turbine engine, wherein the plurality of blade biasers move in an aft direction during rotation of the wheel assembly within the gas turbine engine.

2. The assembly of claim 1, wherein the blade biasers each include (i) a wedge and (ii) a biasing element coupled to the wedge.

3. The assembly of claim 2, wherein each of the wedges has (i) a first portion adjacent the biasing element having a first thickness and (ii) a second portion opposite the first portion having a second thickness, and each of the wedges is tapered so that the first thickness is less than the second thickness.

4. The assembly of claim 2, wherein the biasing elements are arranged to urge the wedges to move parallel to the central axis through the slots to cause the wedges to engage the disk and the roots of each of the plurality of blades to preload the plurality of blades away from the central axis.

5. The assembly of claim 2, wherein (i) each of the biasing elements includes a generally U-shaped spring member, and (ii) the generally U-shaped spring members of the biasing elements are positioned outside of the slots.

6. The assembly of claim 2, further comprising a coating applied between each of the wedges and the disk to resist degradation of the wedges and the disk resulting from relative movement between the wedges and the disk parallel to the central axis during operation of the gas turbine engine.

7. The assembly of claim 2, wherein each blade biaser is a monolithic component.

8. The assembly of claim 2, wherein the wedge of at least one of the blade biasers comprises a pin having an elliptical cross-sectional shape.

9. The assembly of claim 8, wherein the biasing element of the at least one of the blade biasers comprises an arm coupled to the pin.

10. A wheel assembly for a gas turbine engine, the assembly comprising a disk arranged for rotation about a central axis, the disk formed to include a plurality of slots circumferentially arranged adjacent one another, a plurality of blades, the plurality of blades including roots sized to be received in the plurality of slots so that the plurality of blades are coupled to the disk for common rotation about the central axis, and a plurality of blade biasers positioned in the plurality of slots between the disk and the roots of each of the plurality of blades, the blade biasers each including (i) a wedge and (ii) a biasing element coupled to the wedge and having an arm positioned outside of the slots during operation of the gas turbine engine.

11. The assembly of claim 10, wherein (i) each of the wedges includes a first portion and a second portion arranged closer to the biasing element than the first portion, and (ii) the first portion has a greater thickness than the second portion.

12. The assembly of claim 11, wherein the biasing elements are arranged to urge the wedges to move parallel to the central axis through the slots to cause the first portions of the wedges to engage the disk and the roots of each of the plurality of blades.

13. The assembly of claim 10, further comprising a coating applied between each of the wedges and the disk to resist degradation of the wedges and the disk resulting from relative movement between the wedges and the disk parallel to the central axis during operation of the gas turbine engine.

14. The assembly of claim 10, wherein each of the wedges comprises a pin having an elliptical cross-sectional shape.

15. The assembly of claim 14, wherein the arm is coupled to the pin.

16. A method of preloading a blade of a wheel assembly for a gas turbine engine, the method comprising arranging a blade biaser in one of a plurality of slots formed in a disk of the wheel assembly between the disk and a root of the blade sized to be received in the one of the plurality of slots so that the blade biaser engages the disk and the root of the blade in a first position prior to operation of the wheel assembly, and operating the wheel assembly to cause the blade to experience a centrifugal load during operation of the wheel assembly that allows the blade biaser to move in the one of the plurality of slots to engage the disk and the root of the blade in a second position different from the first position to preload the blade away from a center of the disk, wherein operating the wheel assembly comprises rotating an oval-shaped portion of the blade biaser in the one of the plurality of slots between the first position and the second position.

17. The method of claim 16, wherein (i) arranging the blade biaser in the one of the plurality of slots comprises arranging a first portion of the blade biaser having a first thickness in the one of the plurality of slots so that the first portion engages the disk and the root of the blade in the first position, and (ii) operating the wheel assembly comprises engaging a second portion of the blade biaser having a second thickness greater than the first thickness with the disk and the root of the blade in the second position.

* * * * *